US005682746A

United States Patent [19]

von Hoerner

[11] Patent Number: 5,682,746

[45] Date of Patent: Nov. 4, 1997

[54] EXHAUST GAS RETURN SYSTEM FOR A TURBO-CHARGED INTERNAL COMBUSTION ENGINE

[75] Inventor: Roland von Hoerner, Nürnberg, Germany

[73] Assignee: MAN Nutzfahrzeuge Aktiengesellschaft, Nürnberg, Germany

[21] Appl. No.: 664,989

[22] Filed: Jun. 13, 1996

[30] Foreign Application Priority Data

Jun. 14, 1995 [DE] Germany ..... 195 21 573.7

[51] Int. Cl.[6] ..... F02M 25/07

[52] U.S. Cl. ..... 60/605.2

[58] Field of Search ..... 60/605.2; 123/570

[56] References Cited

U.S. PATENT DOCUMENTS 3,682,151 8/1972 Tatsutomi ..... 123/570

FOREIGN PATENT DOCUMENTS 1-177446 7/1989 Japan ..... 60/605.2

*Primary Examiner*—Michael Koczo

*Attorney, Agent, or Firm*—Robert W. Becker & Associates

[57] ABSTRACT

An exhaust gas return system for a turbo-charged internal combustion engine, wherein the exhaust gas is guided via an exhaust gas manifold to a turbine of an exhaust gas turbo charger and wherein a compressor connected to the turbine guides the charge air to a charge air pipe, a check valve is branched off the exhaust gas manifold and is biased into a closed position. The check valve is opened by the exhaust gas pressure within the exhaust gas manifold. An exhaust gas line connects the check valve to the charge air pipe.

1 Claim, 2 Drawing Sheets

EXHAUST GAS RETURN SYSTEM FOR A TURBO-CHARGED INTERNAL COMBUSTION ENGINE

BACKGROUND OF THE INVENTION

The invention relates to an exhaust gas return system for a turbo-charged internal combustion engine in which the exhaust gas is supplied via an exhaust gas manifold to a turbine of an exhaust gas turbo charger and wherein the charge air is supplied with a compressor to a charge air pipe connected to the turbine.

For improving the exhaust gas quality, especially for reducing nitrogen oxides of turbo-charged, air-compressed internal combustion engines, a portion of the exhaust is returned to the charge air. Problems with such an exhaust gas return system result when the charge air pressure is greater than the average exhaust gas pressure within the exhaust gas manifold upstream of the turbine.

It is therefore an object of the present invention to provide a reliable return system for the exhaust gas from the exhaust gas manifold upstream of the turbine into the charge air pipe with a constructive expenditure that is as small as possible.

SUMMARY OF THE INVENTION

The exhaust gas return system for a turbo-charged internal combustion engine, wherein the exhaust gas is guided via an exhaust gas manifold to a turbine of an exhaust gas turbo charger and wherein a compressor connected to the turbine guides the charge air to a charge air pipe, according to the present invention is primarily characterized by:

a check valve branching off the exhaust gas manifold;

the check valve biased into a closed position;

the check valve opened by the exhaust gas pressure within the exhaust gas manifold; and an exhaust gas line connecting the check valve to the charge air pipe.

Preferably, the check valve comprises a valve housing and a flutter valve positioned in the valve housing. The valve housing has an interior provided with cooling ribs and is cooled by the engine coolant. The flutter valve is opened by the exhaust gas pressure within the exhaust gas manifold. Preferably, the exhaust gas line comprises a control valve positioned between the check valve and the charge air pipe.

Thus, according to the present invention, the object is solved by branching off a check valve from the exhaust gas manifold, by the check valve being opened by the exhaust gas pressure counter to a return force, and by connecting the check valve via an exhaust gas line to the charge air pipe.

Upon opening of the exhaust valves, pressure peaks result within the exhaust gas manifold upstream of the turbine which considerably surpass the average charge air pressure and which, according to the invention, for a short period of time open the check valve and return exhaust gas into the charge air pipe. With a minimal constructive expenditure, it is thus possible in a reliable manner to return exhaust gas, even for turbo-charged internal combustion engines, into the charge air pipe.

An advantageous improvement is characterized in that the check valve comprises a flutter valve which provides a very simple embodiment of a check valve. The valve housing is incorporated into the cooling circuit of the internal combustion engine so that the flutter valve is thermally relieved. This results in long service life.

In order to be able to suppress an undesired return of exhaust gas, it is suggested to arrange between the check valve and the charge air pipe a control valve within the exhaust gas line. The control valve avoids in certain operational conditions the unwanted return of exhaust gas.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of a specific embodiment utilizing FIGS. 1 through 3.

Figure 1:
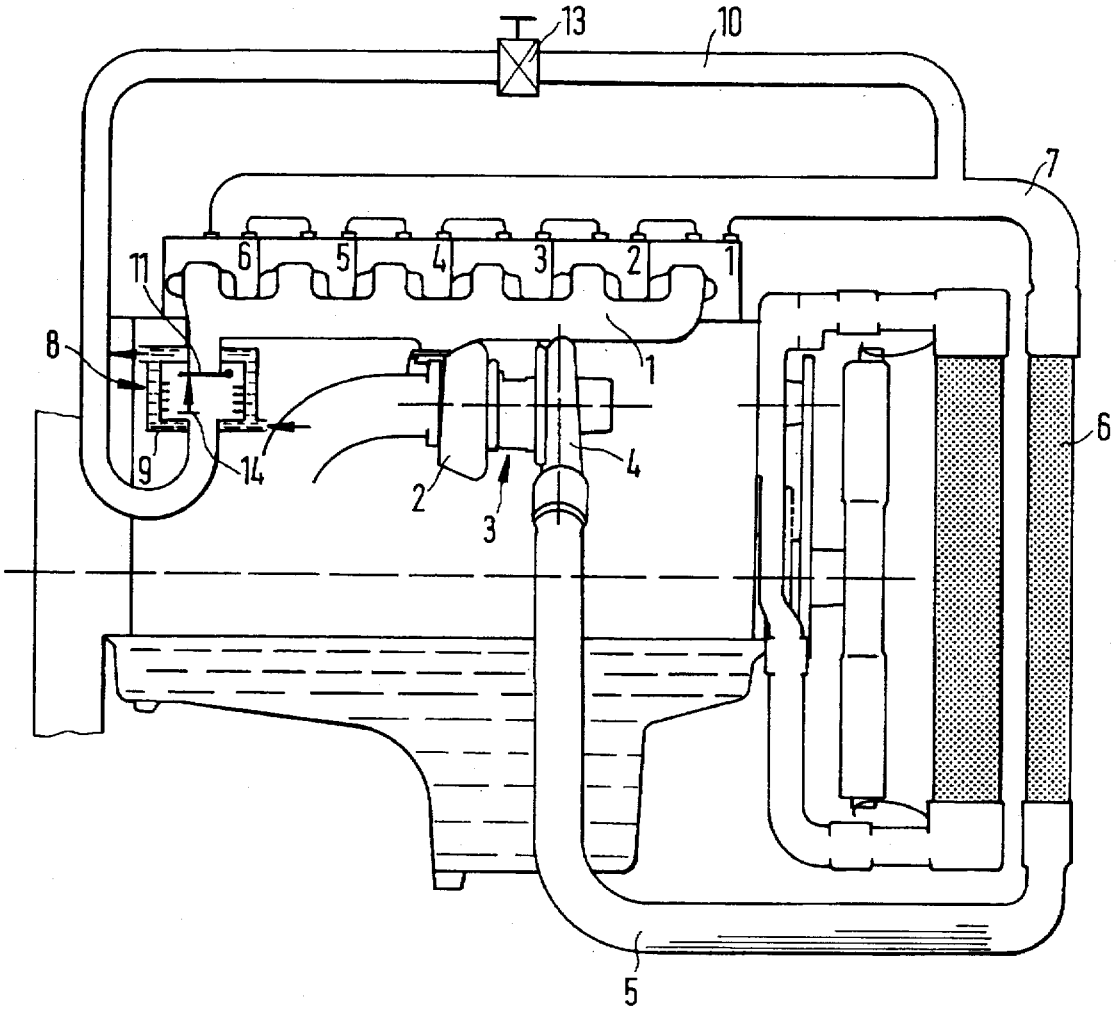
FIG. 1 shows a turbo-charged internal combustion engine with check valve for returning exhaust gas.

FIG. 1 shows the inventive return system for exhaust gas mounted on a turbo-charged, air-compressed internal combustion engine. The exhaust gas of the individual cylinders is guided into a common exhaust gas manifold 1 and from there into a turbine 2 of an exhaust gas turbo charger 3. The turbine 2 is seated on the same shaft as the compressor 4 which guides compressed charge air via charge air line 5 and a charge air cooler 6 to the charge air pipe 7.

In order to be able to return portions of exhaust gas from the exhaust gas manifold 1 into the charge air pipe 7, according to the present invention the exhaust gas pipe 1 has connected thereto a check valve 8 the valve housing 9 of which is connected via an exhaust gas line 10 to the charge air pipe 7.

The check valve 8 can advantageously be embodied as a flutter valve 11. The flutter valve 11 is opened inventively by exhaust gas pressure peaks, occurring during opening of the exhaust valve, counter to the average pressure of the charge air within the charge air line 7 so that portions of the exhaust gas can be returned.

After the exhaust gas peaks have subsided, the flutter valve 11 is closed by the charge air pressure because the charge air pressure is greater than the average exhaust gas pressure, In order to be able to prevent an undesirable return of exhaust gas under certain operational conditions, for example, when driving at full load or partial load, it is possible to provide in the exhaust gas line 10 a control valve 13 which opens only when it is desired to return exhaust gas.

In order to ensure an extended service life of the check valve 8, it is advantageous to connect the valve housing 9 to the engine coolant circuit so that the valve housing 9 is surrounded by cooling water.

For controlling the valve stroke of the flutter valve 11, an abutment 14 may be provided. By varying the position of the abutment 14 it is possible to effect the rate of exhaust gas return in any operational state.

Figure 2:
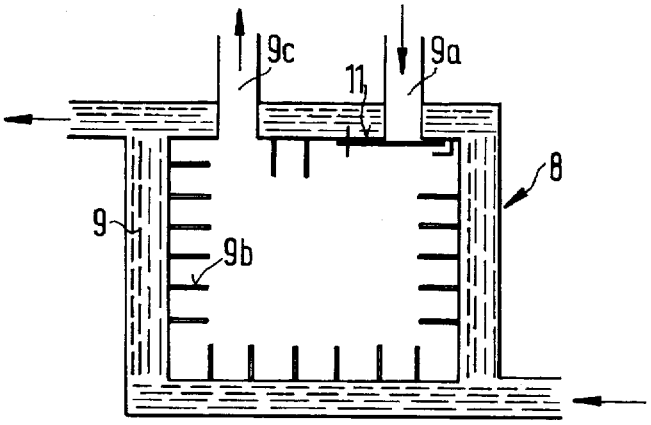
FIG. 2 shows a cross-section of the check valve.

A cross-section of a further embodiment of the check valve 8 is shown in FIG. 2. The exhaust gas exiting from the exhaust gas manifold 1 (FIG. 1) is guided via a first socket 9*a* into the check valve 8. The flutter valve 11 opens when an exhaust gas peak occurs. The interior of the valve housing 9 is provided with cooling ribs 9*b* in order to transfer heat energy from the exhaust gas onto the cooling water flowing through the valve housing 9. The valve housing 9 thus also performs the function of a cooler for the returned exhaust gas. Via a second socket 9*c* the exhaust gas is guided to the exhaust gas line 10 and into the charge air pipe 7 (FIG. 1). The sockets 9*a*, 9*c* are arranged on the same side in order to simplify the connection to exhaust gas manifold 1 and exhaust gas line 10.

Figure 3:
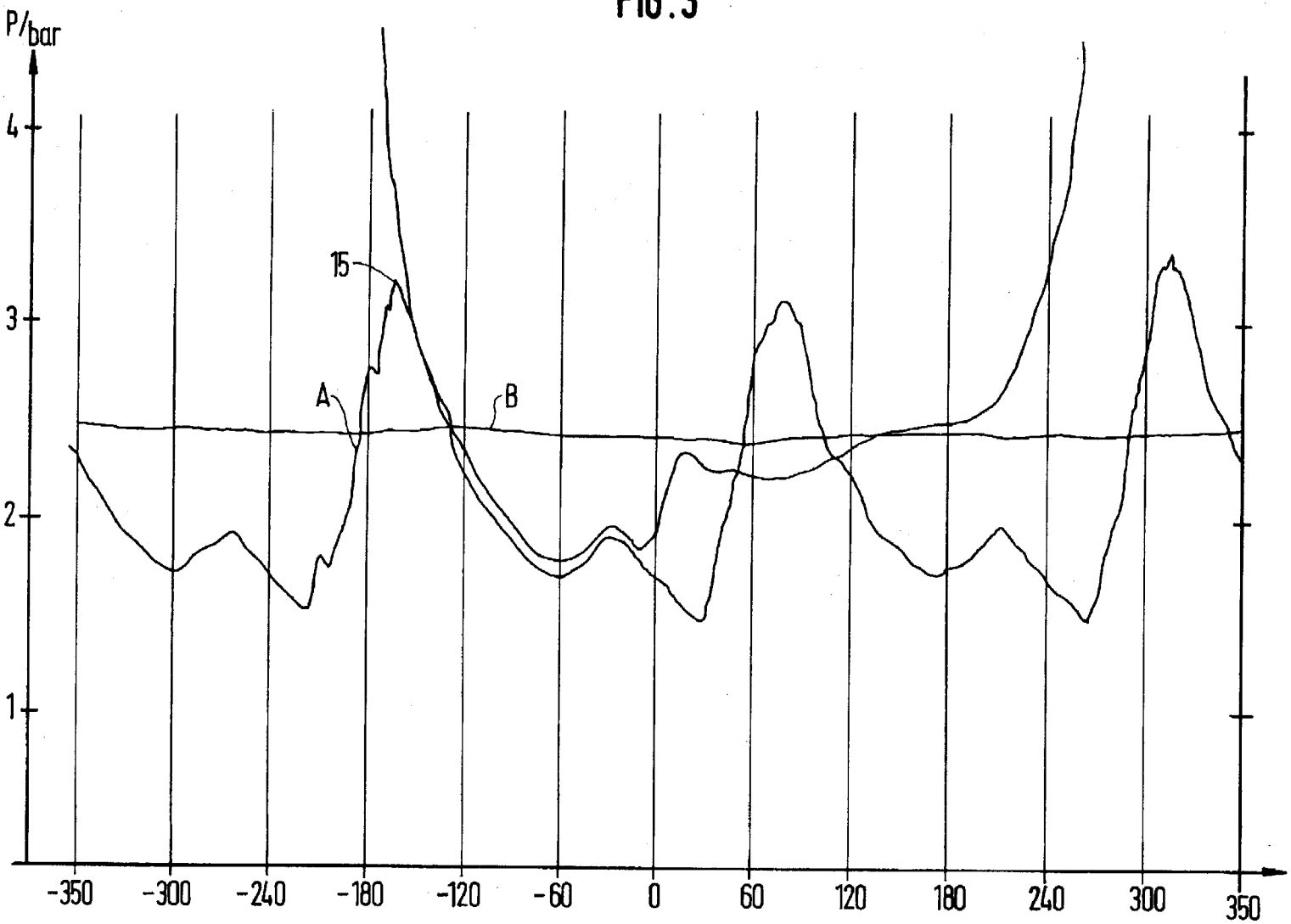
FIG. 3 shows a representation of the course of the pressure of charge air and exhaust gas as a function of the angle of rotation of the crank shaft.

FIG. 3 shows the course of the exhaust gas pressure upstream of the turbine 2 (FIG. 1) as a function of the crank shaft angle. The curve A shows a considerable exhaust gas peak 15. The peak 15 occurs always during opening of an exhaust valve when the piston is in the area of the lower dead center.

This pressure of the exhaust gas peak 15 is considerably higher than the charge air pressure of curve B so that upon high pressure (curve A) exhaust gas is returned counter to the pressure of the charge air as shown in curve B. The control of the exhaust gas return system is carried out by the check valve 8 (FIG. 1).

The present invention is, of course, in no way restricted to the specific disclosure of the specification and drawings, but also encompasses any modifications within the scope of the appended claims.

What I claim is:

1. An exhaust gas return system for a turbo-charged internal combustion engine, wherein the exhaust gas is guided via an exhaust gas manifold to a turbine of an exhaust gas turbo charger and wherein a compressor connected to the turbine guides the charge air to a charge air pipe; said system comprising:

a check valve branching off the exhaust gas manifold and directly connected to a mouth of the exhaust gas manifold;

said check valve biased into a closed position;

said check valve comprising a valve housing and a flutter valve positioned directly at the mouth of the exhaust gas manifold within said valve housing;

said check valve opened by exhaust gas pressure peaks within the exhaust gas manifold;

an exhaust gas line connecting said check valve to the charge air pipe;

said valve housing being cooled by an engine coolant.

* * * * *